US005094380A

United States Patent [19]

Nasiatka

[11] Patent Number: 5,094,380

[45] Date of Patent: Mar. 10, 1992

[54] GUIDE FOR FASTENER DRIVING TOOL

[75] Inventor: John R. Nasiatka, Northbrook, Ill.

[73] Assignee: Duo-Fast Corporation, Franklin Park, Ill.

[21] Appl. No.: 421,011

[22] Filed: Oct. 13, 1989

[51] Int. Cl.[5] ..... B25C 1/04

[52] U.S. Cl. ..... 227/156; 227/130

[58] Field of Search ..... 227/120, 130, 156

[56] References Cited

U.S. PATENT DOCUMENTS

| | | | |
|---|---|---|---|
| 3,205,782 | 9/1965 | Volkmann | 227/156 X |
| 3,580,455 | 5/1971 | Oberlenninger | 227/130 X |
| 3,592,211 | 3/1971 | Doyle | 227/130 X |
| 3,893,610 | 7/1975 | Smith | 227/130 X |
| 3,905,535 | 9/1975 | Novak et al. | 227/130 X |
| 4,319,205 | 3/1982 | Geist et al. | 227/156 X |
| 4,604,675 | 8/1986 | Pflederer . | |
| 4,670,715 | 6/1987 | Fuzzell . | |
| 4,928,867 | 5/1990 | Jensen | 227/156 X |

OTHER PUBLICATIONS

Caterpillar Special Instruction Publication entitled, "Using the 8T8697 Electronic Analyzer Programmer (ECAP)", dated Dec. 1987.

*Primary Examiner*—Timothy V. Eley

*Attorney, Agent, or Firm*—Mason, Kolehmainen, Rathburn & Wyss

[57] ABSTRACT

A guide for use with a fastener driving tool which positions the fastener driving tool with respect to the workpiece and also controls the degree of penetration of the fastener with respect to the workpiece to allow for contraction and expansion of the workpiece due to temperature changes. The guide includes a rigid U-shaped member which may be attached to either a wire type or flat type safety yoke.

7 Claims, 3 Drawing Sheets

Fig. 2
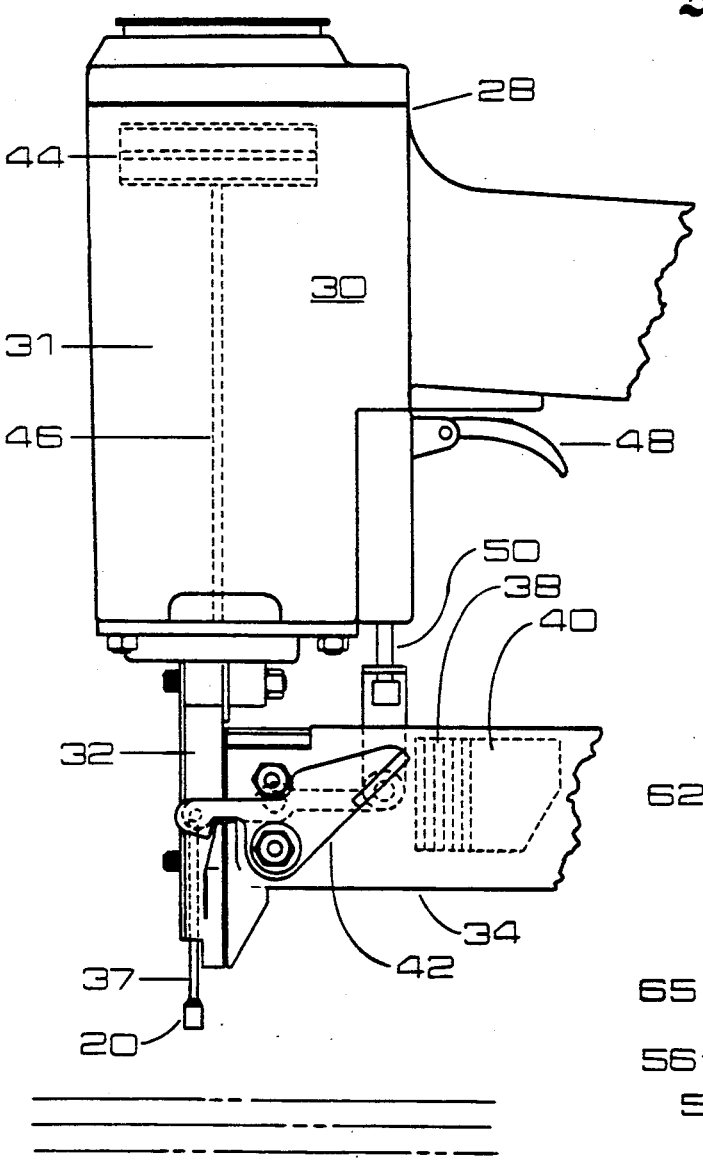
Fig. 4
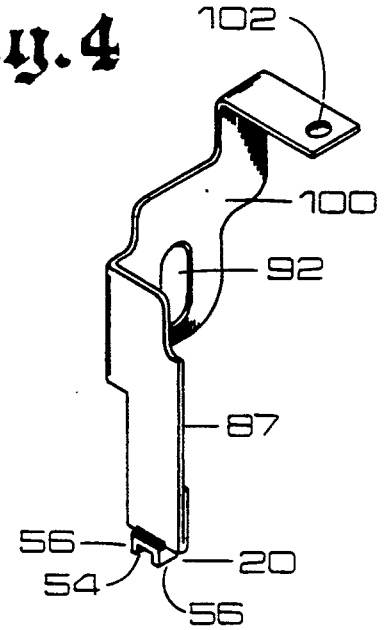
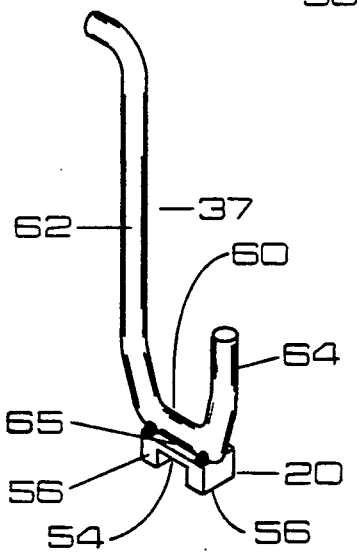
Fig. 3

GUIDE FOR FASTENER DRIVING TOOL

1. FIELD OF THE INVENTION

The present invention relates to fastener driving tools and more particularly to fastener driving tools which include a guide formed as a rigid member for locating a fastener driving tool relative to a workpiece, such as aluminum or vinyl siding, and controlling the degree of penetration of the fastener into the workpiece.

2. DESCRIPTION OF THE PRIOR ART

Aluminum and vinyl siding is secured to a supporting wood structure with fasteners, such as nails or staples. Power operated fastener driving tools are known to significantly reduce the time required to install such siding. Standard fastening techniques for securing the siding to the wood support structure, however, can cause problems. For example, variations in the outdoor temperature can cause the siding to contract and expand. If the siding is securely fastened to the wood support structure, damage can result. Also, in some known fastener driving tools, the normal driving stroke of the tool can not be precisely controlled. In such tools the fastener can overpenetrate the siding and cause damage.

Fastener driving tools are known which have means for controlling the degree of fastener penetration into a workpiece. For example, U.S. Pat. No. 4,821,937 to Rafferty, assigned to the same assignee as the assignee of the present invention, discloses an adjustable guide assembly for a fastener driving tool used to secure siding to a supporting wood structure. The guide disclosed in the '937 patent includes a pair of spring loaded guide pins which extend downwardly from the nosepiece of the tool. The spring loaded guide pins are spaced apart and adapted to be received in fastener receiving slots formed along one edge of the siding. Such spring loaded guide pins can occasionally stick due to a build up of dirt in the assembly which, in turn, can result in additional maintenance costs. Also, the guide assembly disclosed in the Rafferty '937 patent is a rather complicated assembly which includes moving parts and thus is relatively expensive to manufacture.

SUMMARY OF THE INVENTION

It is an object of the present invention to solve the problems associated with the prior art.

It is another object of the present invention to provide a rigid guide for positioning a fastener driving tool relative to a workpiece, such as vinyl and aluminum siding.

It is a further object of the present invention to provide a guide for a fastener driving tool which controls the degree of penetration of the fastener into a workpiece to allow for contraction and expansion of the workpiece.

Briefly, the present invention relates to a guide for a fastener driving tool which controls the degree of penetration of the fastener with respect to the workpiece to allow for contraction and expansion due to temperature variations and also positions the tool with respect to the workpiece. The guide includes a rigid U-shaped member which may be attached to either a wire type or flat type safety yoke.

DESCRIPTION OF THE DRAWING

The present invention together with the above and other objects and advantages may be best understood from the following detailed description and the accompanying drawing wherein:

FIG. 2 is a partial elevational view of a fastener driving tool illustrating the guide in accordance with the present invention;

FIG. 3 is a perspective view of a wire type safety yoke incorporating the guide in accordance with the present invention;

FIG. 6 is similar to FIG. 5 and illustrates a safety yoke of the type shown in FIG. 3;

DETAILED DESCRIPTION

Figure 1:
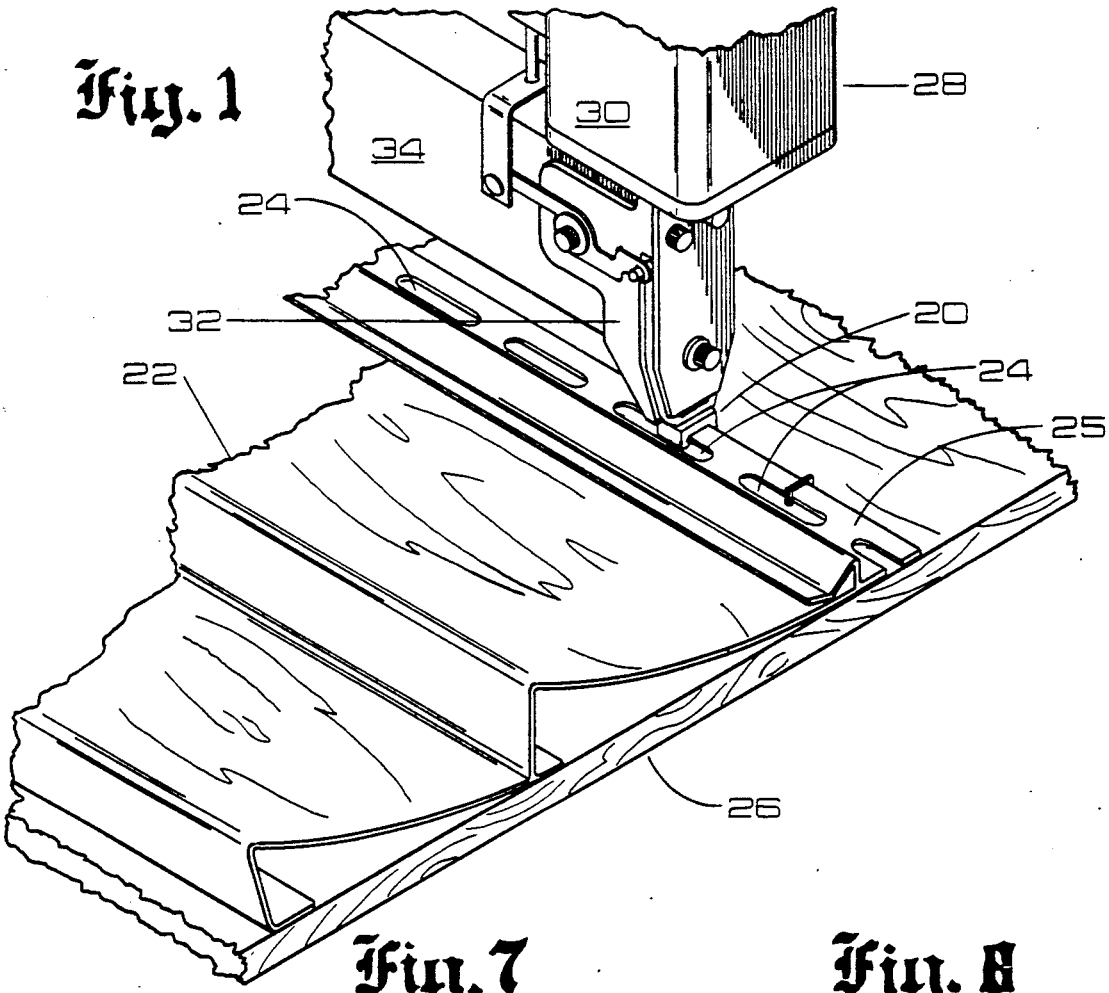
FIG. 1 is a partial perspective view of a #fastener driving tool which includes a guide in accordance with the present invention illustrating the guide being used to secure a piece of siding to a wood support structure.

With reference with to the drawing, the guide in accordance with the present invention is generally identified with the reference numeral 20. As shown in FIG. 1, the guide 20 is adapted to be used with a workpiece 22, such as aluminum or vinyl siding, which has a plurality of fastener receiving slots 24 along one edge 25 for securing the siding 22 to a wood support structure 26. The guide 20 is further adapted to be used with various types of vinyl and aluminum siding including siding with insulated backings. In such applications, the degree of penetration of the staple is maintained constant, however, longer staples are used to provide at least ¾ inch penetration into the wood support structure 26.

As shown and described herein, the guide 20 can be utilized with various types of fastener driving tools having a reciprocally mounted safety yoke. However it should be appreciated by those of ordinary skill in the art that the principals of the invention are not so limited. For example, the guide 20 may be used with a fastener driving tool without a reciprocally mounted safety yoke, such as a fastener driving tool having a pivotally mounted magazine as disclosed in co-pending application Ser. No. 07/367,787, filed on June 19, 1989 and assigned to the same assignee as the present invention, hereby incorporated by reference. In such a tool, the guide 20 may be attached either directly to the nosepiece of the tool or to an extension attached to the nosepiece.

Specifically, the guide 20 can be used with fastener driving tools 28, such as the tools disclosed in U.S. Pat. Nos. 3,638,532 and 3,905,535, assigned to the same assignee as the present invention and hereby incorporated by reference. Such tools 28 include a housing 30, a pneumatically operated drive assembly 31, a nosepiece 32, a magazine 34, a trigger assembly 36 and a reciprocally mounted safety yoke 37. It should also be understood, however, that the principals of the present invention are also applicable to other types of fastener driving tools, such as electrically operated fastener driving tools.

The magazine 34 acts as a carrier and supplies a plurality of fasteners, such as staples 38, to a drive track (not shown) defined by the nosepiece 32. A pusher 40 advances the staples 38 to the drive track. A latch assembly 42 is provided to allow the magazine assembly 34 to be latched in place for proper operation and unlatched for reloading of the fasteners 38 into the magazine 34. The drive assembly 31 includes a reciprocally mounted piston 44 for driving a driver blade 46. The driver blade 46 drives fasteners 38, such as staples, along the drive track into a wood support structure 26.

The trigger assembly 36 includes a trigger valve (not shown) a trigger 48 and a trigger pin 50. As described in more detail in the aforesaid U.S. Patents that have been incorporated by reference, the trigger pin 50 cooperates with the trigger valve to preclude operation of the tool 28 unless the safety yoke 37 is in engagement with a workpiece 22. More specifically, when the safety yoke 37 is in engagement with a workpiece 22 (FIG. 7), the safety yoke 37 moves upwardly to an operate position which, in turn, causes the trigger pin 50 to move downwardly. This action allows the control of the tool 28 to be transferred to the trigger 48 so that staples 38 or other fasteners can be driven into a workpiece whenever the trigger 48 is actuated. Alternatively, when the safety yoke 37 is in its downward or safety position (FIG. 8), the trigger pin 50 is in an upward position which prevents operation of the tool 28.

Figure 4:
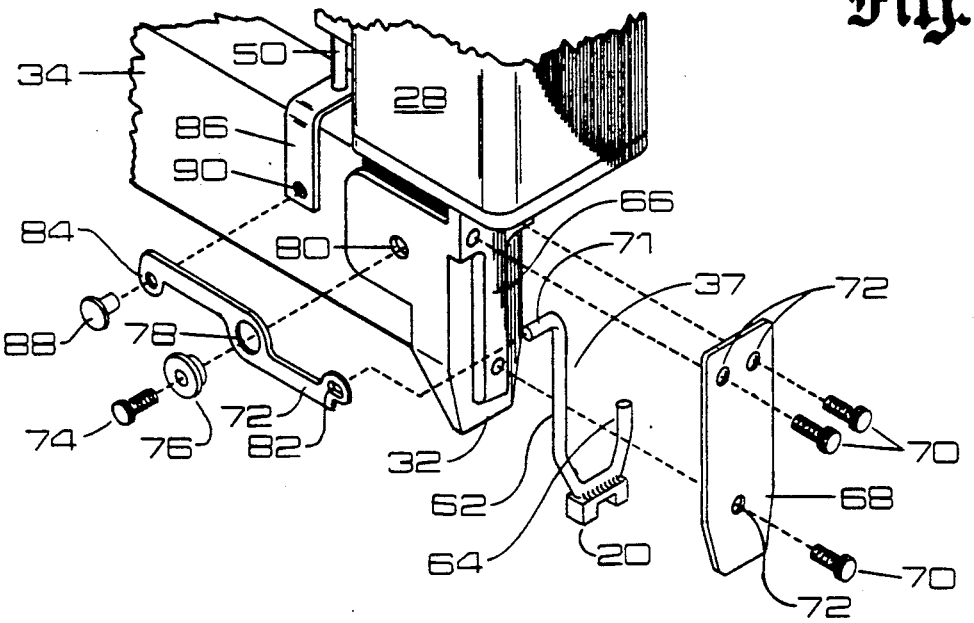
FIG. 4 is a perspective view of an alternative embodiment illustrating a flat type safety yoke incorporating the guide in accordance with the present invention.
Figure 5:
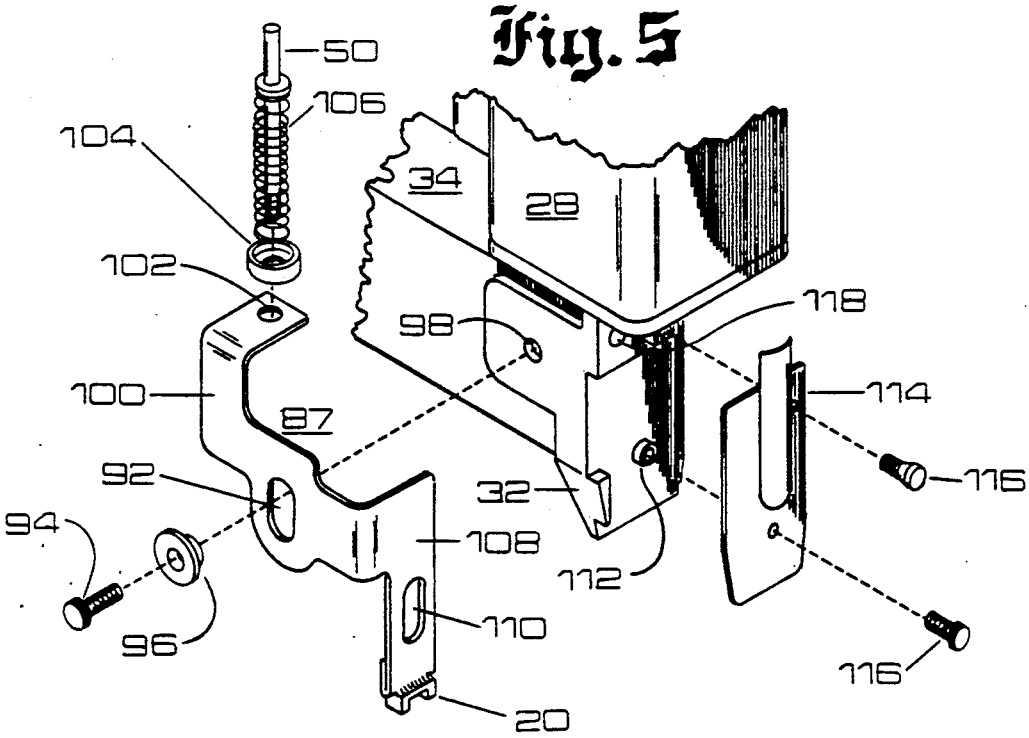
FIG. 5 is a partial exploded perspective view of a portion of a fastener driving tool incorporating a safety yoke of the type illustrated in FIG. 4.

The guide 20 in accordance with the present invention is adapted to be used with different type safety yokes 37. For example, the guide 20 can be incorporated into a flat type safety yoke as illustrated in FIGS. 4 and 5 or a wire type safety yoke illustrated in FIGS. 3, 6, 7 and 8. In both embodiments the guide 20 may be attached to the bottom portion of a safety yoke 37, for example, by welding, brazing or the like in a plane adjacent the drive track to allow a fastener 38 to be driven into a workpiece. The guide 20 is formed as a rigid one-piece U-shaped member having a bight portion 54 and two spaced apart depending leg portions 56. The bight portion 54 is generally disposed to allow its longitudinal axis to be disposed generally perpendicular to the edge 25 of the siding 22. The length of the bight portion 54 is such to allow one of the depending legs 56 to be disposed in the fastener receiving slot 24 while the other leg 56 is disposed adjacent the edge 25 of the siding 22, as shown in FIG. 1.

The length of each of the legs 56 is such that the bight portion 54 of the guide 20 is raised a predetermined distance, for example 1/32 inch, above the siding 22. Since the legs 56 of the guide 20 raise the safety yoke 37 above the siding 22 by a predetermined distance, the degree of penetration of the fastener 38 into the siding 22 will be decreased by that predetermined distance for a particular size fastener 38. This permits expansion and contraction of the siding 22 due to temperature fluctuations without damage to the siding 22.

Referring to FIGS. 3, 6, 7 and 8, the guide 20 is attached to a wire type safety yoke 37, formed as a J-shaped member having a bight portion 60, a long leg 62 and a relatively shorter leg 64. The bight portion 60 of the wire type safety yoke 37 is shaped to provide a relatively flat surface 65 for attachment of the guide 20.

With both the wire type and the flat type, the safety yoke 37 is attached to the nosepiece 32 slightly differently than shown and illustrated in the aforesaid patents. Specifically, in the first embodiment, the spacing between the relatively long leg 62 and the relatively short leg 64 of the wire type safety yoke 37 is such to allow the legs 62 and 64 to straddle a rib 66 formed on the nosepiece 32. This arrangement prevents movement of the safety yoke 37 from side to side relative to the tool 28. The rib 66 emanates from the top of the nosepiece 32 and extends substantially downwardly toward the bottom of the nosepiece 32. A retention plate 68 is used to capture the safety yoke 37 with respect to the nosepiece 32. The retention plate 68 is attached to the nosepiece 32 with a plurality of fasteners 70, inserted through the apertures 72 in the retention plate 68 and received in the nosepiece 32.

The top portion of the safety yoke 37 is bent over forming a 90° angle defining an extending leg portion 71. The extending leg portion 71 is adapted to cooperate with a yoke link 72. The yoke link 72 is pivotally mounted to the side of the tool with a fastener 74 and a shoulder washer 76, received in an aperture 78 in the yoke link 72 and a tapped hole 80 in the side of the nosepiece 32. An aperture 82 formed on one end of the yoke link 72 is adapted to receive the extending leg portion 71 of the safety yoke 37. Another aperture 84 formed on the other end of the yoke link 72 is connected to a trigger lever 86 which communicates with the trigger pin 50. More specifically, a fastener 88, such as a rivet, is received in the aperture 84 in the yoke link 72 and received in an aperture 90 in the trigger lever 86. The trigger lever 86 is an L-shaped member defining a bearing surface for actuating the trigger pin 50.

Figure 7:
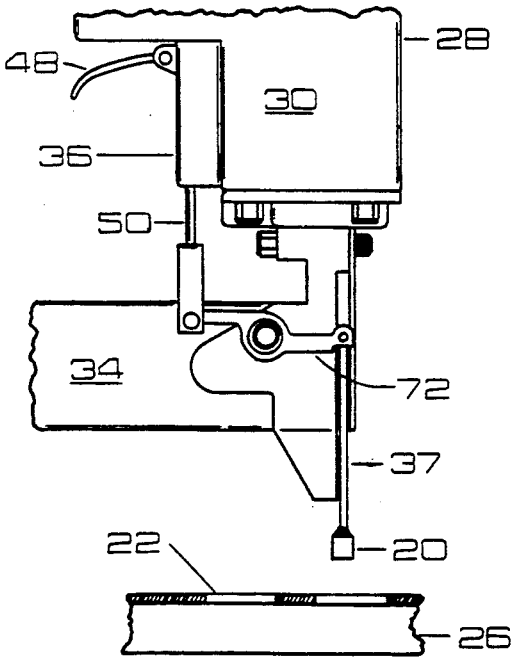
FIG. 7 is a partial elevational view of a fastener driving tool incorporating a guide in accordance with the present invention illustrated in a safety position.
Figure 8:
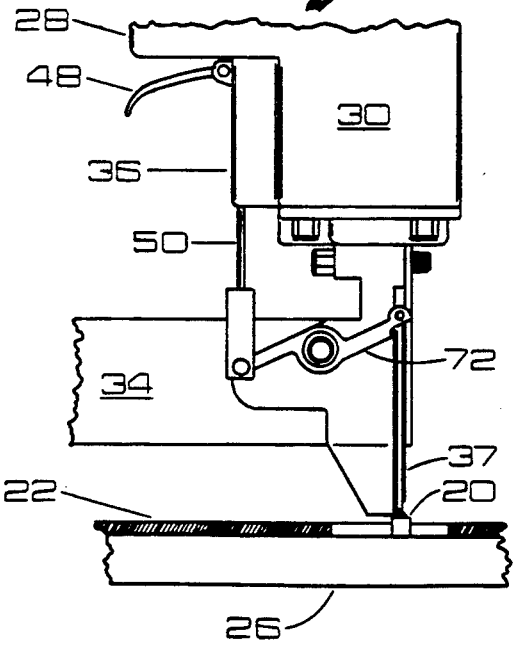
FIG. 8 is similar to FIG. 7 but illustrates the assembly in an operate position.

As best shown in FIG. 7 and 8, the yoke link 72 is mounted for reciprocal movement from a safety position as shown in FIG. 7 to an operate position as shown in FIG. 8. Pivotal movement of the yoke link 72 causes the trigger lever 86 to move upwardly and downwardly. Such action causes movement of the trigger pin 50. In the safety position as shown in FIG. 7, the trigger pin 50 is displaced upwardly. While the trigger pin 50 is in this position the drive assembly 31 is disabled. Once the safety yoke 37 is moved upwardly due to engagement with a work piece 22, the yoke link 72 rotates in a counterclockwise direction (FIG. 8). This action allows the trigger pin 50 to move downwardly to enable the drive assembly 31 to place the tool under control of the trigger 48.

In an alternative embodiment, a flat type safety yoke is utilized. This embodiment is illustrated in FIGS. 4 and 5 and operates similarly to the previously mentioned embodiment. The guide 20 is disposed on the bottom portion of the safety yoke 87. In this embodiment, the safety yoke 87 is provided with a slot 92 to allow for a reciprocal connection of the safety yoke 87 to the side of the nosepiece assembly 32 by way of a threaded fastener 94 and a shoulder washer 96 received in a tapped hole 98. The safety yoke 87 includes an L-shaped portion 100 having an aperture 102 for receiving one end of the trigger pin 50. The other end of the trigger pin 50 is received into the trigger assembly 36. A biasing spring 106 is disposed about the trigger pin 50 and received in a spring retainer 104.

Another portion 108 of the flat type safety yoke 87 is formed with an elongated slot 110. The slot 110 is for receiving a boss 112 with a center tapped hole, internally formed on the nosepiece 32. A retainer 114 is fastened to the nosepiece 32 by way of a plurality of fasteners 116 received in a tapped hole 118 in the nosepiece 32 and the boss 112. This arrangement allows for reciprocal movement of the safety yoke 87 with respect to the nosepiece 32.

While the invention has been described with reference to details of the embodiments shown in the drawing these details are not intended to limit the scope of the invention as described in the following claims.

What is claimed and described to be desired to be secured by letters patent of the United States is:

1. A guide for a fastener driving tool which defines a drive track for driving fasteners into a workpiece comprising:

a rigid U-shaped member defining a pair of depending legs and a bright portion adapted to engage a workpiece; and means for disposing said U-shaped member adjacent the drive track of a fastener driving tool to position a fastener driving tool relative to a workpiece.

2. A guide as recited in claim 1, wherein said disposing means includes a safety yoke.

3. A guide as recited in claim 2, wherein said safety yoke is a wire type safety yoke.

4. A guide as recited in claim 2, wherein said safety yoke is a flat type safety yoke.

5. A guide as recited in claim 1, wherein said rigid U-shaped member includes means for positioning said drive track relative to siding having fastener receiving slots along one edge.

6. A guide as recited in claim 5, wherein said depending legs are disposed generally in parallel and spaced apart a predetermined distance selected to allow one of said depending legs to be disposed within a fastener receiving slot and the other of said depending legs to be disposed adjacent said edge.

7. A guide as recited in claim 5, wherein said depending legs are formed with a predetermined length selected to control the degree of penetration of the fastener relative to the workpiece.

* * * * *